US009494359B2

(12) United States Patent
Pfleiderer et al.

(10) Patent No.: US 9,494,359 B2
(45) Date of Patent: Nov. 15, 2016

(54) HORIZONTAL FINNED HEAT EXCHANGER FOR CRYOGENIC RECONDENSING REFRIGERATION

(75) Inventors: Glen G. Pfleiderer, Voorheesville, NY (US); Robert A. Ackermann, Schenectady, NY (US)

(73) Assignee: Koninklijke Philips N.V., Eindhoven (NL)

( * ) Notice: Subject to any disclaimer, the term of this patent is extended or adjusted under 35 U.S.C. 154(b) by 635 days.

(21) Appl. No.: 13/061,711

(22) PCT Filed: Aug. 27, 2009

(86) PCT No.: PCT/IB2009/053756

§ 371 (c)(1),
(2), (4) Date: Mar. 2, 2011

(87) PCT Pub. No.: WO2010/029456

PCT Pub. Date: Mar. 18, 2010

(65) Prior Publication Data

US 2011/0160064 A1 Jun. 30, 2011

Related U.S. Application Data

(60) Provisional application No. 61/095,392, filed on Sep. 9, 2008.

(51) Int. Cl.
*H01F 6/06* (2006.01)
*F25D 19/00* (2006.01)
(Continued)

(52) U.S. Cl.
CPC ..... *F25D 19/006* (2013.01); *F25B 9/145* (2013.01); *F25B 2400/17* (2013.01); *H01F 6/04* (2013.01); *Y10T 29/4935* (2015.01)

(58) Field of Classification Search
CPC ..... F25J 2290/44; F28D 2021/0028; F25B 9/145; F25B 9/14; F25B 9/10; F28F
(Continued)

(56) References Cited

U.S. PATENT DOCUMENTS 2,538,957 A * 1/1951 Askevold et al. ..... 261/151
2,970,669 A * 2/1961 Bergson ..... 96/139
(Continued)

FOREIGN PATENT DOCUMENTS

CN 1982828 A 6/2007
CN 101082471 A 12/2007
(Continued)

OTHER PUBLICATIONS

Domingo, N. Condensation of R-11 on the outside of vertical enhanced tubes. International Conference on Alternative Energy Sources, Miami Beach, FL, USA, Dec. 14, 1981. Available at http://www.osti.gov/energycitations/serylets/purl/5488727-Fy48Bc/native/5488727.pdf.*
(Continued)

*Primary Examiner* — Frantz Jules
*Assistant Examiner* — Brian King

(57) ABSTRACT

A cryogenic system includes a superconducting magnet (20) in a reservoir of liquid helium (LH). Helium vapor (VH) rises and contacts a recondenser surface (50, 50', 50") on which the helium vapor (VH) condenses into liquid helium and flows by gravity off a lower edge of the recondenser surface. A plurality of fins (52) extend from the recondenser surface or a plurality of grooves (52', 52") are cut into the recondenser surface to disrupt the film thickness and to provide a path by which droplets of the liquid helium leave the recondenser surface without travelling a full vertical length of the recondenser (30).

12 Claims, 3 Drawing Sheets

(51) Int. Cl.
*F25B 9/14* (2006.01)
*H01F 6/04* (2006.01)

(58) Field of Classification Search
CPC ..... 2009/029;F28F 2009/0292; F28F 2001/428
USPC ..... 62/45.1, 47.1, 48.1, 48.2, 51.1; 165/118, 913, 184
See application file for complete search history.

(56) References Cited

U.S. PATENT DOCUMENTS

| | | | | | |
|---|---|---|---|---|---|
| 3,384,154 | A | * | 5/1968 | Milton | 165/133 |
| 4,562,703 | A | * | 1/1986 | Miller et al. | 62/51.1 |
| 4,926,646 | A | | 5/1990 | Dorri et al. | |
| 4,971,139 | A | * | 11/1990 | Khattar | 165/86 |
| RE33,878 | E | * | 4/1992 | Bartlett et al. | 62/47.1 |
| 5,379,600 | A | * | 1/1995 | Moritsu et al. | 62/51.1 |
| 5,682,751 | A | * | 11/1997 | Langhorn et al. | 62/51.1 |
| 5,775,187 | A | | 7/1998 | Nikolai | |
| 5,782,095 | A | | 7/1998 | Chen | |
| 5,992,513 | A | * | 11/1999 | Suzuki et al. | 165/133 |
| 6,196,005 | B1 | | 3/2001 | Stautner | |
| 7,290,598 | B2 | * | 11/2007 | Hanin et al. | 165/185 |
| 7,762,318 | B2 | | 7/2010 | Yu et al. | |
| 2002/0002830 | A1 | | 1/2002 | Strobel et al. | |
| 2004/0029270 | A1 | | 2/2004 | Germain et al. | |
| 2004/0112065 | A1 | | 6/2004 | Pan | |
| 2005/0189099 | A1 | * | 9/2005 | Hanin et al. | 165/181 |
| 2006/0090882 | A1 | | 5/2006 | Sauciuc | |
| 2007/0131396 | A1 | * | 6/2007 | Yu et al. | 165/133 |

FOREIGN PATENT DOCUMENTS

| | | | | |
|---|---|---|---|---|
| EP | 0245057 | A2 | | 5/1987 |
| EP | 1418388 | A2 | | 5/2004 |
| GB | 2414538 | A | | 11/2005 |
| JP | 57014184 | A | * | 1/1982 |
| JP | 60101590 | A | | 6/1985 |
| JP | 60101590 | U | | 7/1985 |
| JP | 61225556 | A | | 10/1986 |
| JP | 5275231 | A | | 10/1993 |
| JP | 09178382 | A | | 7/1997 |
| WO | 0039513 | A1 | | 7/2000 |

OTHER PUBLICATIONS

Takazawa and Kajikawa. Condensing Heat Transfer Enhancement on Vertical Spiral Double Fin Tubes with Drainage Gutters. J. Solar Energy Eng. vol. 107, Issue 3. pp. 222-228. (1985).*

* cited by examiner

HORIZONTAL FINNED HEAT EXCHANGER FOR CRYOGENIC RECONDENSING REFRIGERATION

CROSS REFERENCE TO RELATED APPLICATIONS

This application claims the benefit of U.S. provisional application Ser. No. 61/095,392 filed Sep. 9, 2008, which is incorporated herein by reference.

The present application relates to the cryomagnetic arts. It finds particular application in conjunction with magnetic resonance systems employing superconducting magnets and will be described with particular reference thereto. However, it will also find utility in other applications involving the recondensation of helium vapor.

Many magnetic resonance systems employ superconducting magnets in order to efficiently attain high magnetic fields, e.g., 1.5 Tesla, 3 Tesla, 7 Tesla, etc. Superconducting magnets are maintained at a temperature that is below the critical temperature for superconductivity of the electric current driving the operating superconducting magnet windings. Because the superconducting temperature is typically below the 77° K temperature at which nitrogen liquefies, liquid helium is commonly used to cool the superconducting magnets.

In a closed loop helium cooling system, a vacuum-jacketed helium dewar contains the superconducting magnet immersed in liquid helium. As the liquid helium slowly boils off, it is recondensed into liquid helium to form a closed system. The helium vapor is brought in contact with a cold head, also known as a helium vapor recondenser, which has a recondenser surface cooled to a temperature at which helium recondenses.

In some recondensers, the recondensation surface includes a vertically disposed smooth metal structure, e.g., a cylinder, on which smooth metal surface the helium recondenses. The recondensed liquid helium flows down the bottom of the recondenser surface and falls back into the liquid helium reservoir within the dewar. Although the recondensation on the cold surface may occur in film or dropwise condensation, the dominant form is film condensation in which a liquid film covers the entire condensing surface. Under the action of gravity, the film flows continuously from the surface. However, the liquid helium has a sufficiently high surface tension that a relatively thick helium film can be supported on the vertical surface.

In some recondensers, the recondensing surface has smooth, longitudinal (vertical) fins extending along the surface in the direction of flow. Although such fins increase the surface area, the fins lead to the formation of a thick film along the fins and restrict the formation of liquid droplets at the end of the recondenser surface.

While such cryorecondensers are effective, the present inventors have recognized that the film of liquid helium on the recondenser surface functions as an insulating layer between the recondensation surface and the helium vapor, reducing the efficiency of the regenerative cryogenic refrigerator system.

The present application provides an improved system and method which overcomes the above-referenced problems and others.

In accordance with one aspect, a cryogenic system is provided. A liquid helium vessel contains liquid helium. Superconducting magnet windings are immersed in the liquid helium. A helium vapor recondenser has a smooth recondenser surface on which helium vapor recondenses, which recondenser surface is intermittently interrupted by a structure which one or more of causes the liquid helium which condenses to leave the recondenser surface without travelling the full length of the recondenser and/or disrupts a thickness of a film of the liquid helium forming on the recondenser surface.

In accordance with another aspect, a method of maintaining superconducting magnets immersed in liquid helium is provided. Helium vapor which boils off from the liquid helium is recondensed on a smooth recondenser surface forming a liquid helium film on the recondenser surface. The liquid helium film is disrupted intermittently along the smooth recondenser surface.

In accordance with a further aspect of the method, the liquid helium is caused to leave the smooth recondenser surface without travelling a full vertical length of the recondenser surface.

In accordance with another aspect, a recondenser includes a cooled object having a smooth surface configured to be mounted along a vertical axis such that liquids on the surface flow by gravity toward a lower end of the surface. A plurality of fins extend peripherally around the smooth surface with a top edge of each fin being flush with a smooth surface portion immediately above and with a bottom edge of each fin being larger in perimeter than the top edge. A smooth sloping surface is defined between the top edge and the bottom edge of each fin.

One advantage resides in improved recondenser efficiency.

Another advantage resides in smaller, less energy consumptive recondensing systems.

Still further advantages and benefits will become apparent to those of ordinary skill in the art upon reading and understanding the following detailed description.

The invention may take form in various components and arrangements of components, and in various steps and arrangements of steps. The drawings are only for purposes of illustrating sample embodiments and are not to be construed as limiting the invention.

FIG. 3 is a side view of a second embodiment of the recondenser with spiral grooves; and.

Figure 1:
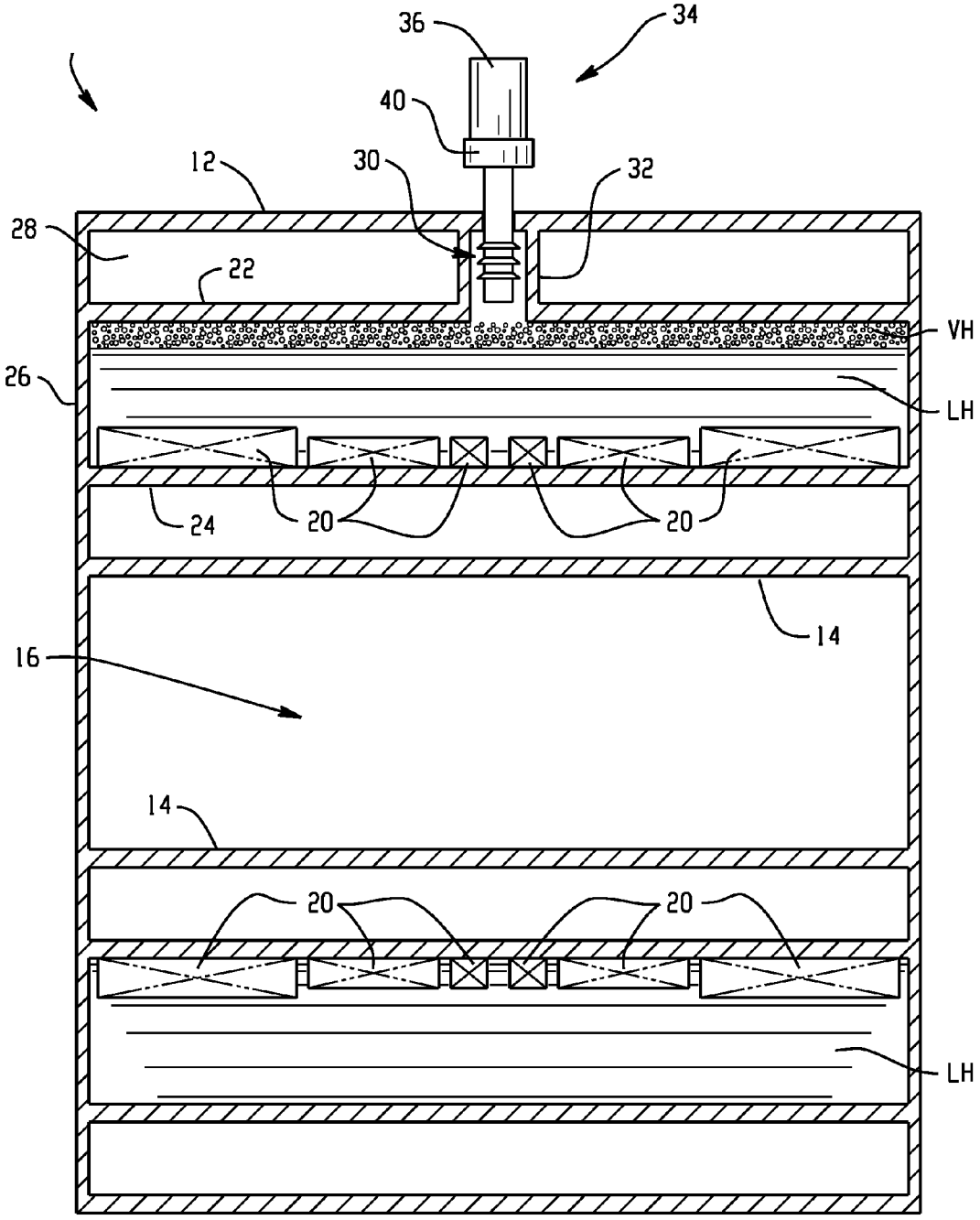
FIG. 1 is a side sectional view of a diagrammatic illustration of a magnetic resonance system including a helium vessel with a regenerative cryogenic refrigerator.

With reference to FIG. 1, a magnetic resonance system 10, illustrated as a horizontal-bore type system, includes an annular housing 12 with an inner cylindrical wall 14 surrounding and defining a generally cylindrical horizontally-oriented bore 16. Although a horizontal bore type system is illustrated, it is to be understood that the present concepts are also applicable to superconducting open magnetic resonance systems, C-magnets, and the like.

The illustrated magnetic resonance system 10 includes superconducting magnet windings 20 arranged to generate a static ($B_0$) magnetic field oriented coaxially with the bore 16 at least in an examination region located generally at or near an isocenter of the bore 16. In the illustrated system, the superconducting magnet windings 20 have a generally solenoidal configuration in which they are wrapped coaxially around the bore 16. However, other configurations are also contemplated. Additionally, active shim windings, passive steel shims, and additional components (not shown) may also be provided.

To keep the superconducting magnet windings 20 below a critical temperature for superconductivity while maintaining an electric current sufficient to generate a desired static magnetic field magnitude, the superconducting magnets are immersed in liquid helium LH that is disposed in a generally annular liquid helium vessel or dewar defined by an outer wall 22, an inner annular wall 24, and side walls 26. To provide thermal isolation, the outer wall 22 is surrounded by a vacuum jacket 28.

Although not illustrated in diagrammatic FIG. 1 for simplicity of illustration, the vacuum jacket is typically provided for the side walls 26 as well. Additional thermal isolation components, such as a surrounding liquid nitrogen jacket or dewar, are also contemplated, but are not illustrated in FIG. 1. The magnetic resonance system includes additional components such as a set of magnetic field gradient coils which are typically disposed on one or more cylindrical formers disposed coaxially inside the inner cylinder 14; an optional whole-body cylindrical radio frequency coil which again is typically disposed on one or more cylindrical dielectric formers disposed coaxially inside the cylinder wall 14; an optional one or more local radio frequency coils or coil arrays such as a head coil, joint coil, torso coil, surface coil, array of surface coils, or the like, which are typically placed at strategic locations within the bore proximate to a region of interest of a subject; and the like. Other components not illustrated in FIG. 1 include electronics for operating the magnetic field gradient coils and radio frequency transmit coils and data processing components for reconstructing a magnetic resonance image, performing magnetic resonance spectroscopy, or otherwise processing or analyzing acquired magnetic resonance data.

The liquid helium is substantially thermally isolated by walls 22, 24, 26, the surrounding vacuum jacket 28, and other insulation. However, imperfect thermal isolation together with other sources of heating, generally lead to a slow vaporization of the liquid helium LH. This is diagrammatically illustrated in FIG. 1 by a region of vapor helium VH that collects above the surface of the liquid helium LH. The superconducting magnet windings 20 are immersed in the liquid helium LH.

To provide a closed loop regenerative cryogenic refrigeration system, the helium vapor VH is recondensed into liquid helium on a recondenser 30 disposed outside of the liquid helium vessel, but connected to the liquid helium vessel via a neck 32. The recondenser is kept at a temperature sufficiently low to promote the condensation of the helium vapor, for example, kept at a temperature below about 4.2° K, by the cold head 34 driven by a cryocooler motor 36. Because the cryocooler motor 36 has electrically conductive motor windings, it is preferably disposed outside of the magnetic field generated by the superconducting magnet windings 20. To provide vibrational isolation, the cryocooler motor is mounted via a flexible coupling 40.

In operation, the vapor helium VH expands into the neck 32 and contacts the recondenser 30 where the vapor liquefies to form condensed liquid helium, particularly a liquid helium film. Because the recondensation surface is positioned above the liquid helium vessel, the recondensed liquid helium drops, under the force of gravity, back into the liquid helium vessel or dewar.

Figure 2:
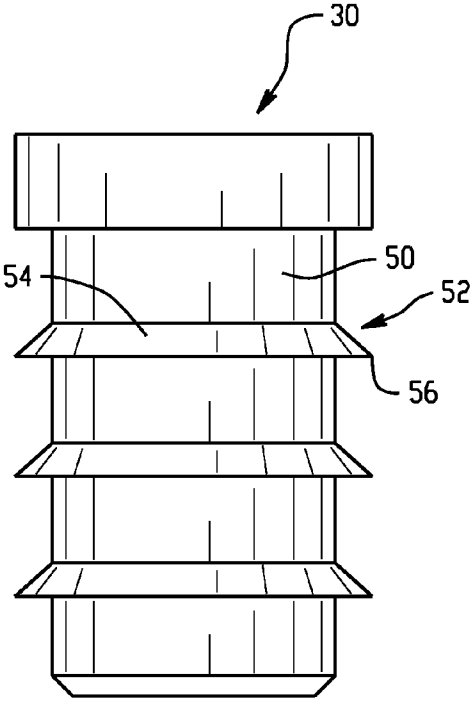
FIG. 2 is a side view of a recondenser with horizontal fins.
Figure 5:
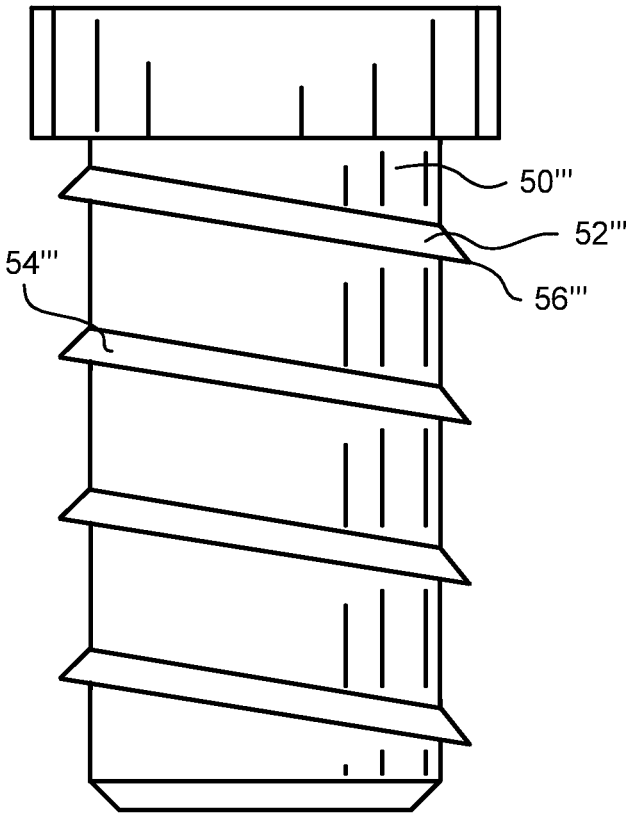
FIG. 5 is a side view of the recondenser with spiral fins.

With continuing reference to FIG. 1 and further reference to FIG. 2, the recondenser 30 includes a smooth, generally cylindrical recondenser surface 50 which surface is interrupted periodically to form a plurality of surface portions or segments by a radially extending fin or structure 52. With a cylindrical recondenser surface 50, the fins 52 are annular. With reference to FIG. 5, with a cylindrical recondenser surface 50''', the fins 52''' are spiral. Of course, other cross sections for the recondenser surface 50 and the fin 52 are contemplated. In this manner, the smooth recondenser surface 50 is interrupted periodically with the fins 52 that define a tapered smooth surface 54 which terminates in a sharp edge 56.

Condensation of helium vapor on the recondenser 30 may occur in two forms: dropwise condensation or film condensation. The dominant form is film condensation which occurs when a liquid film covers the entire cold surface. Gravity causes this film to flow gradually from the top down towards the bottom, covering the surface with a condensation layer. The thickness of the layer increases towards the lower edge of the recondenser 30. In the illustrated embodiment, a bottom surface of the fin is horizontal to facilitate manufacture by a machining operation. Of course, multiple pieces are also contemplated. In the illustrated embodiment with three finds, the recondenser surface is divided into four shorter portions or segments. The shorter surface segments support a thinner thickness film than would a longer surface.

The fins 52 perform two functions. First, they interrupt the film forming on the smooth recondenser surface 50 between each fin which limits the height of the film section, hence its thickness. Second, the sharp edge of the fin 56 forms a drip edge from which recondensed liquid helium drops, hence removing it from the recondenser surface 30 and returning it to the dewar.

The rate of cooling by the recondenser 30 is a function of the heat transfer coefficient between the surface and the helium vapor which is represented by the formula: $h=K_1/\delta$. Here the rate of cooling h is proportional to the thermal conductivity $K_1$ divided by the film thickness $\delta$. This cooling, of course, decreases when the thermal conductivity $K_1$ decreases and when the thickness $\delta$ increases. Thus, the thicker the coating of liquid helium, the slower the rate of cooling and the less efficient the regenerative cryogenic refrigerator becomes. Thinning the liquid helium layer and removing liquid helium from the recondenser 30 both promote more efficient cooling and recondensation of the helium vapor.

Figure 3:
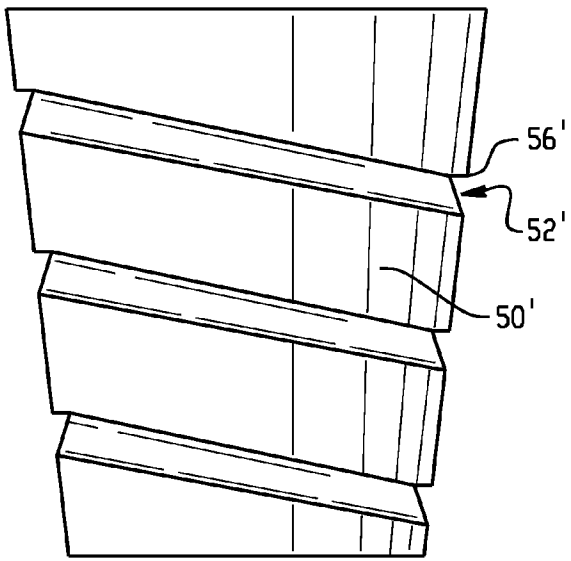

With reference to FIG. 3, the recondenser 30 can include a recondenser surface 50' of shapes other than cylindrical, e.g., a tapered, truncated cone. Further, interruptions to the smooth surface can be provided by projecting ribs or inwardly extending grooves 52'. The grooves 52' again have a sharp edge 56' which facilitates removal of the liquid helium at intermediate locations along the recondensation surface before reaching the bottom of the recondenser. Moreover, the interruptions in the liquid helium film again reduce the thickness of the film. The channels 52', like the fins 52 may be a series of annular rings. Alternately, the fins or the groove can be in the form of one or more spirals as illustrated in FIG. 3. The spiral may include a single groove or fin, or a plurality of parallel grooves or fins.

Figure 4:
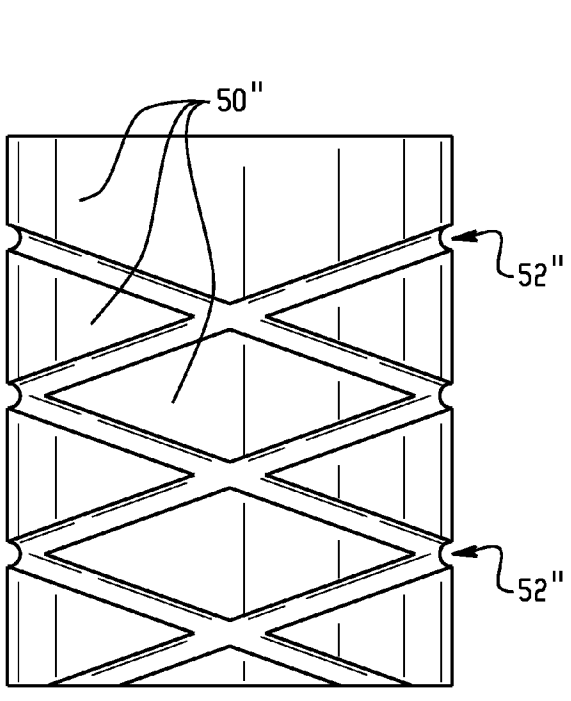
FIG. 4 is a side view of the recondenser with spiral grooves of opposite pitch.

With reference to FIG. 4, the spiral pattern of grooves or fins may include two or more spiraling grooves 52" with substantially opposite pitch forming a cross-hatched pattern on the recondenser surface 50" such that a short vertical path is created along sections of the recondenser surface between the grooves.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A cryogenic system comprising:

a liquid helium vessel containing liquid helium (LH);

superconducting magnet windings immersed in the liquid helium;

a helium vapor recondenser with a smooth surface recondenser in which helium vapor recondenses which recondenser surface is intermittently interrupted by an interrupting structure which at least one of causes liquid helium which condenses on the smooth surface to leave the recondenser without travelling a full vertical length of the recondenser on the smooth surface and disrupts a thickness of a liquid helium film forming on the recondenser surface, wherein the interrupting structure is a fin that extends in a spiral along a length of the recondenser, wherein the fin has a sloping upper surface which slopes downward away from an adjacent recondenser surface portion and a bottom surface, wherein the upper surface and bottom surface meet and terminate along a line that forms a sharp drip edge from which liquid helium droplets leave the recondenser surface without travelling a full length of the recondenser surface.

2. The cryogenic system according to claim 1, wherein the recondenser surface is generally cylindrical.

3. A cryogenic system comprising:

a liquid helium vessel containing liquid helium (LH);

superconducting magnet windings immersed in the liquid helium;

a helium vapor recondenser with a smooth surface recondenser in which helium vapor recondenses which recondenser surface is intermittently interrupted by an interrupting structure which at least one of causes liquid helium which condenses on the smooth surface to leave the recondenser without travelling a full vertical length of the recondenser on the smooth surface and disrupts a thickness of a liquid helium film forming on the recondenser surface, wherein the interrupting structure includes a groove extending inwardly from the recondenser surface, and wherein the recondenser surface circumference is tapered along a vertical axis from a top horizontal edge to a bottom horizontal edge.

4. The cryogenic system according to claim 3, wherein the smooth surface of the recondenser is vertically oriented.

5. The cryogenic system according to claim 3, wherein the recondenser surface is vertically oriented, and wherein the groove extends in a spiral around the recondenser surface.

6. The cryogenic system according to claim 3, wherein the groove is cut into the recondenser surface, an upper edge of the groove being configured to meet the smooth recondenser surface with a sharp edge.

7. The cryogenic system according to claim 6, further including a plurality of grooves arranged in a spiral pattern on the recondenser surface.

8. A method of manufacturing a helium vapor recondenser with a smooth surface recondenser in which helium vapor recondenses which recondenser surface is intermittently interrupted by an interrupting structure which at least one of causes liquid helium which condenses on the smooth surface to leave the recondenser without travelling a full vertical length of the recondenser on the smooth surface and disrupts a thickness of a liquid helium film forming on the recondenser surface, wherein the interrupting structure is a fin that extends in a spiral along a length of the recondenser, wherein the fin has a sloping upper surface which slopes downward away from an adjacent recondenser surface portion and a bottom surface, wherein the upper surface and bottom surface meet and terminate along a line that forms a sharp drip edge from which liquid helium droplets leave the recondenser surface without travelling a full length of the recondenser surface, the method comprising:

machining a metal element to define an annular smooth recondenser surface interrupted by the spiral extending fins projecting from the smooth annular surface.

9. A method of maintaining superconductive magnet windings immersed in liquid helium (LH), the method comprising:

recondensing helium vapor (VH) which boils off from the liquid helium on a smooth recondenser surface forming a liquid helium (LH) film on the recondenser surface;

intermittently along the smooth recondenser surface, disrupting the liquid helium film, wherein the disrupting is caused by a fin that extends in a spiral along a length of the smooth recondenser surface, wherein the fin has a sloping upper surface which slopes downward away from an adjacent smooth recondenser surface and a bottom surface wherein the upper surface and bottom surface meet and terminate along a line that forms a sharp drip edge.

10. The method according to claim 9, wherein the step of disrupting the helium film includes:

causing the liquid helium to leave the smooth recondenser surface without travelling a full vertical length of the recondenser surface.

11. The method according to claim 9, wherein the drip edge allows liquid helium to drips and return by gravity to the liquid helium that immerses the superconducting magnet windings.

12. A recondenser comprising:

a cooled object having a smooth surface configured to be mounted along a vertical axis such that liquids on the surface flow by gravity toward a lower end of the surface;

a fin extending spirally around a periphery of the smooth surface with a top edge of the fin being flush with a portion of the smooth surface portion immediately above and a bottom edge of the fin being larger in perimeter than the top edge, a smooth upper sloping surface being defined between the top edge and bottom edge of the fin, the fin further comprising a bottom surface, wherein the upper sloping surface and the bottom surface meet and terminate along a line that forms a sharp drip edge.

* * * * *